US010309644B2

(12) United States Patent
Leisse et al.

(10) Patent No.: US 10,309,644 B2
(45) Date of Patent: Jun. 4, 2019

(54) METHOD FOR THE IGNITION OF A POWER PLANT BURNER, AND COAL DUST BURNER SUITABLE FOR THE METHOD

(71) Applicant: Mitsubishi Hitachi Power Systems Europe GmbH, Duisburg (DE)

(72) Inventors: Alfons Leisse, Essen (DE); Sebastian Rehfeldt, Essen (DE)

(73) Assignee: MITSUBISHI HITACHI POWER SYSTEMS EUROPE GMBH, Duisburg (DE)

( * ) Notice: Subject to any disclaimer, the term of this patent is extended or adjusted under 35 U.S.C. 154(b) by 5 days.

(21) Appl. No.: 15/026,573

(22) PCT Filed: Oct. 2, 2014

(86) PCT No.: PCT/EP2014/071206

§ 371 (c)(1),
(2) Date: Mar. 31, 2016

(87) PCT Pub. No.: WO2015/055443

PCT Pub. Date: Apr. 23, 2015

(65) Prior Publication Data

US 2016/0238239 A1 Aug. 18, 2016

(30) Foreign Application Priority Data

Oct. 18, 2013 (DE) ..... 10 2013 111 504

(51) Int. Cl.
*F23D 1/00* (2006.01)
*F23Q 7/06* (2006.01)
*F23D 99/00* (2010.01)

(52) U.S. Cl.
CPC ..... *F23D 1/005* (2013.01); *F23D 1/00* (2013.01); *F23D 91/02* (2015.07); *F23Q 7/06* (2013.01); *F23D 2207/00* (2013.01)

(58) Field of Classification Search
CPC ..... F23Q 7/00; F23Q 7/06; F23D 1/005
(Continued)

(56) References Cited

U.S. PATENT DOCUMENTS

| | | | | |
|---|---|---|---|---|
| 4,836,772 | A | 6/1989 | Larue | |
| 4,991,520 | A | 2/1991 | Tsumura et al. | |
| 2010/0077944 | A1* | 4/2010 | Slavejkov | F23C 6/04 110/345 |

FOREIGN PATENT DOCUMENTS

| | | |
|---|---|---|
| DE | 34 24 272 A1 | 1/1985 |
| DE | 33 27 983 A1 | 2/1985 |

(Continued)

OTHER PUBLICATIONS

Translations of DE202007019416, DE3424272, and JP2012112549.*

(Continued)

*Primary Examiner* — Avinash A Savani
*Assistant Examiner* — Aaron H Heyamoto
(74) *Attorney, Agent, or Firm* — Knobbe Martens Olson & Bear LLP

(57) ABSTRACT

One embodiment relates to a burner, comprising a fuel pipe, a fuel nozzle, at least one ignition and/or heat source and a pipe which conducts an oxygen-containing gas and/or recirculated flue gas, wherein the at least one ignition and/or heat source is arranged in the burner interior and is in the form of or comprises an electric heating and/or ignition device via which, exclusively by conversion of electrical current into heat energy, the amount of heat energy required within the burner for the initiation and continuation of the initial pyrolysis and ignition is generated and/or provided in the burner interior. A stabilizing ring with toothed ring may be a constituent part of the electric heating and/or ignition device arranged in the mouth region of the fuel nozzle.

24 Claims, 1 Drawing Sheet

(58) Field of Classification Search
USPC ..... 431/6
See application file for complete search history.

(56) References Cited

FOREIGN PATENT DOCUMENTS

| | | | |
|---|---|---|---|
| DE | 240 245 | A1 | 10/1986 |
| DE | 240245 | A1 | 10/1986 |
| DE | 270576 | A1 | 8/1989 |
| DE | 20 2007 019 416 | U1 | 6/2012 |
| DE | 102011056655 | B4 | 6/2013 |
| JP | 60194211 | A2 | 10/1985 |
| JP | 62268911 | A2 | 11/1987 |
| JP | 63054505 | A2 | 3/1988 |
| JP | 01155105 | A2 | 6/1989 |
| JP | 01217110 | A2 | 8/1989 |
| JP | 2009-024991 | | 2/2009 |
| JP | 2012-112549 | | 6/2012 |
| WO | WO 2013/093678 | A1 | 6/2013 |

OTHER PUBLICATIONS

Official Communication on Examination in German Application No. DE 10 2013 111 504.7, dated Apr. 19, 2016.
International Search Report dated Dec. 15, 2014 for European Application No. PCT/EP2014/071206 filed Oct. 2, 2014.
International Written Opinion dated Dec. 15, 2014 for European Application No. PCT/EP2014/071206 filed Oct. 2, 2014.
Notice of Reasons for Rejection for Korean Application No. 2016-518197 dated May 29, 2018.
Notice of Reasons for Rejection for Application No. JP 2016-518197 dated Jan. 29, 2019.

* cited by examiner

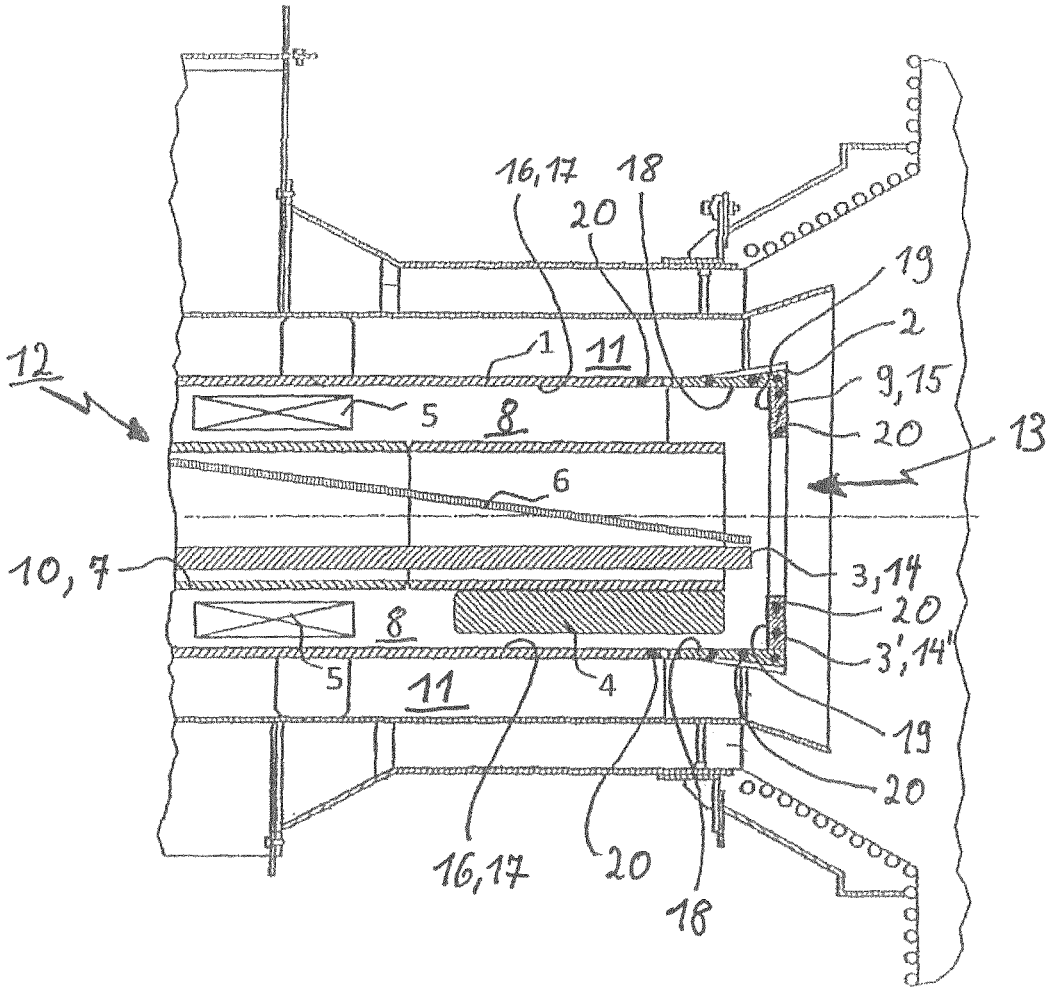
16,17
18
20
19
2
1
11
12
9,15
5
8
20
13
6
10,7
3,14
20
8
3',14'
5
11
4
19
20
16,17
20
18

METHOD FOR THE IGNITION OF A POWER PLANT BURNER, AND COAL DUST BURNER SUITABLE FOR THE METHOD

RELATED APPLICATIONS

This application is the U.S. National Phase of Application No. PCT/EP2014/071206 entitled "METHOD FOR THE IGNITION OF A POWER PLANT BURNER, AND COAL DUST BURNER SUITABLE FOR THE METHOD" filed Oct. 2, 2014, which designated the United States, and which claims the benefit of German Application No. 10 2013 111 504.7 filed Oct. 18, 2013.

The invention is directed to a burner, in particular coal dust burner, comprising a fuel pipe, a fuel nozzle, at least one ignition and/or heat source and a pipe carrying an oxygen-containing gas and/or recirculated flue gas, wherein the at least one ignition and/or heat source is arranged in the burner interior and is formed as or comprises an electrical heating and/or ignition device, which generates and/or provides the amount of thermal energy required within the burner for the origination and execution of the initial pyrolysis and ignition in the burner interior, in particular in the region of the fuel ignition site forming, exclusively by conversion of electric current into thermal energy.

The invention is also directed to a method for igniting a fuel in the form of particles, in particular in the form of dust, by means of a burner, in particular coal dust burner, wherein the fuel is transported in the burner to its ignition site, forming within the burner in the region of the fuel nozzle, and the amount of thermal energy required for the origination and execution of an initial pyrolysis and ignition of the fuel transported to the burner mouth during the starting up of the burner is input into the burner and/or the fuel transported therein exclusively by means of at least one ignition and/or heat source arranged in the burner, which heat source takes the form of a heating and/or ignition device in the burner or is in heat-conducting and/or heat-transferring operative connection with such a heating and/or ignition device arranged in the burner, wherein the required amount of thermal energy is generated and/or provided in the burner interior exclusively by conversion of electric current into thermal energy.

In connection with the feeding of electrical energy from discontinuous, renewable energy sources (for example photovoltaic installations or wind turbines) into the general electricity network, coal-dust-fired power plants must quite often be started up at part loads of whatever low level is desired or taken out of operation, which generally leads to the shutting down of individual burner levels or all the burner levels of the furnace of the steam generator of the power plant. The ignition of coal dust when starting up the burners usually takes place with the aid of gaseous or liquid additional fuels, for example natural gas or light heating oil, which are ignited in an ignition lance arranged at or in the respective coal-dust burner. Only after formation of a continuously burning flame, produced by means of the combustion of such a gaseous or liquid additional fuel, can the coal dust usually be transported to the burners and ignited there in the mouth region. Relatively frequent starting up and shutting down in connection with the feeding of electrical energy from renewable energy sources into the network has the effect of increasing the consumption of these auxiliary fuels greatly, which leads to a considerable increase in the operating costs of thermal, coal-dust-fired power plants configured in this way. In the starting-up and shutting-down operations and during operation at very low part-loads, it is therefore often necessary for burners for gaseous or liquid fuels to be used for support firing. It is appropriate to implement such support firing likewise with a solid fuel in the form of dust, which can be burned with the aid of indirect firing systems, which comprise a prior intermediate storage of the prepared coal dust, and burners suitable for this in the combustion chamber or the furnace of a steam generator.

Burners by means of which solid fuels are burned, often in the form of dust, such as lignite or hard coal or biomass, are used in thermal power plants. For this purpose it is necessary that the ignition of the respective fuel, in particular in the form of dust, takes place in the respective burner or the respective burner device. The ignition of fuels is determined in principle by the processes of the pyrolysis of the fuel in the form of particles or the form of dust, and the oxidation of the combustion of the pyrolysis products thereby produced. To instigate the required processes, the known boundary conditions necessary for this must be satisfied. For the ignition of coal dust, for example, a suitable fuel concentration, a sufficiently high heat transfer, a sufficient dwell time of the dust particles in the region of the pyrolysis and ignition zone and the presence of primary oxygen or an oxidizing agent are essential preconditions. If account is taken of these conditions, the pyrolysis required for the ignition and the oxidation of the pyrolysis products can generally be ensured.

It is usual in practice that an ignition lance that is arranged within the burner and is operated with gaseous fuel forms an ignition flame at which fuel transported in the burner is ignited.

DE 33 27 983 A1 discloses a purely electrically operated ignition device which has an ignition element that ignites fuel emerging from a primary air pipe of the burner.

DD 240 245 A1 discloses a burner of the generic type which has in the mouth region an electrical ignition device, by means of which a coal-dust/air mixture is ignited. At the glowing electrical ignition device, the coal dust carried past ignites and there forms an ignition vortex, which ensures that a rear wall arranged in this region is likewise made to glow.

A burner in which coal dust is ignited by means of a heating rod reaching into the cross section of the fuel pipe is also disclosed in DD 270 576 A1.

The invention is based on the object of providing a solution which, while dispensing with the use of gaseous, liquid or solid additional fuel, allows frequent starting up and shutting down of the burners of a steam generator of a large-scale thermal power plant at low cost with respect to the fuel consumption and provides a burner suitable for this.

This object is achieved according to the invention by a burner with the features of claim 1 and a method with the features of claim 18.

Developments according to the invention and expedient refinements of the invention are the subject of the respective subclaims.

To achieve this, therefore, firstly a burner is provided, in particular coal dust burner, which comprises a fuel pipe, a fuel nozzle, at least one ignition and/or heat source and a pipe carrying an oxygen-containing gas and/or recirculated flue gas, wherein the at least one ignition and/or heat source is arranged in the burner interior and is formed as or comprises an electrical heating and/or ignition device, which generates and/or provides the amount of thermal energy required within the burner for the origination and execution of the initial pyrolysis and ignition in the burner interior, in particular in the region of the fuel ignition site forming, exclusively by conversion of electric current into thermal energy, wherein a stabilizing ring with a toothed rim is a constituent part of the electrical heating and/or ignition device arranged in the mouth region of the fuel nozzle.

Similarly to achieve this, a method is provided, for igniting a fuel in the form of particles, in particular in the form of dust, by means of such a burner, in particular coal dust burner, wherein the fuel is transported in the burner to its ignition site, forming within the burner in the region of the fuel nozzle, and the amount of thermal energy required for the origination and execution of an initial pyrolysis and ignition of the fuel transported to the burner mouth during the starting up of the burner is input into the burner and/or the fuel transported therein exclusively by means of at least one ignition and/or heat source arranged in the burner, which heat source takes the form of a heating and/or ignition device in the burner or is in heat-conducting and/or heat-transferring operative connection with such a heating and/or ignition device arranged in the burner, wherein the required amount of thermal energy is generated and/or provided in the burner interior exclusively by conversion of electric current into thermal energy, wherein the required amount of thermal energy is input into the burner and/or into the transported fuel by means of a heating and/or ignition device which is arranged in the mouth region of the fuel nozzle and a constituent part of which is a stabilizing ring with a toothed rim.

Therefore, in its first aspect, the invention is based on the fact that, in a power plant, burners, in particular coal dust burners, which are subjected to a frequent starting-up process, can be operated at lower cost by the thermal energy that is required in the respective start-up for implementing the pyrolysis and ignition of the fuel in the form of particles, in particular in the form of dust, being generated entirely and exclusively by means of a heating and/or ignition device generating the amount of thermal energy necessary for the initial pyrolysis and ignition of the fuel, in particular in the form of dust, electrically, i.e. by conversion of electric current, and inputting it within the burner into the fuel transported in the burner. The fact that no ignition lance operated with gaseous or liquid (additional) fuel is necessary any longer means that there is no need for the costly structural measures for arranging such a burner lance in a respective burner and the supply devices and shut-off and control valves necessary for the provision of the (additional) fuel. It also means that there is no need for the consumption of additional liquid, gaseous or solid fuel for the operation of the respective ignition lance. The amount of energy necessary when starting up such a burner, in particular coal dust burner, for implementing and ensuring the necessary initial pyrolysis and ignition of the fuel is generated solely electrically, i.e. by conversion of electric current into thermal energy. In large power plants, electric current is frequently available at various voltage levels. The initial ignition for the first time in each case of the carbon, in particular in the form of dust, transported in the burner, in particular coal dust burner, and the initiation and maintenance necessary for this of an initial pyrolysis of the fuel transported in the burner is therefore achieved exclusively by means of one or more exclusively electrically operated heating and/or ignition devices and is moreover input into the burner and/or the fuel exclusively within the burner.

According to a further aspect of the invention, therefore, it is provided that a purely electrically operated ignition and/or heat source or heating and/or ignition device is arranged and formed in the burner interior within the burner. An additional aspect is that this purely electrically operated ignition and/or heat source or heating and/or ignition device introduces and inputs the (amount) of thermal energy required for the initial pyrolysis and the ignition of the fuel into components or structural elements of the burner, and consequently into the burner. From these components or structural elements, the input (amount) of thermal energy can then be delivered to the fuel flowing past and input into it, so that the (amount) of thermal energy required for the initial pyrolysis and ignition is fed to this fuel by way of these components or elements. According to a further aspect, however, it is also possible that the purely electrically operated ignition and/or heat source or heating and/or ignition device delivers the generated (amount) of thermal energy directly to the fuel flowing past and inputs it into this fuel. Finally, according to a further aspect of the invention, it is also possible that a number of electrically operated ignition and/or heat sources or heating and/or ignition devices are arranged and formed in the burner interior within a burner, wherein then in particular at least one of the ignition and/or heat sources or heating and/or ignition devices introduces or inputs electrically generated thermal energy into the burner, i.e. components or structural elements of the burner, and another of the ignition and/or heat sources or of the heating and/or ignition devices within the burner introduces and inputs thermal energy into the fuel flowing therein. It is also possible, however, for all of the heat sources or ignition devices to introduce thermal energy exclusively into components and structural elements of the burner.

With respect to the method, a further aspect is that the amount of thermal energy required, in particular when starting up the burner, within the burner for the origination and execution of the initial pyrolysis and ignition is generated without the use of a further additional liquid, gaseous or solid fuel apart from the fuel initially to be pyrolyzed and ignited. The fuel initially to be pyrolyzed is the fuel in the form of dust or in the form of particles, in particular coal dust, which is also provided in the further operation of the burner as a feedstock fuel for the combustion to produce the burner flame.

The amount of thermal energy required in the burner for the origination and execution of the initial pyrolysis and ignition is generated by means of the heating and/or ignition device exclusively by conversion of electric current into thermal energy and/or an arc and/or a plasma and input into the fuel. By ensuring the dwell time of the fuel transported in the burner that is necessary for the origination and execution of the initial pyrolysis or the initiation and implementation of the initial pyrolysis process in the region of the (effective) surface in the burner interior and/or contact surface and/or inner surface of the fuel pipe and/or of the heating and/or ignition device that is at the temperature necessary for the implementation of the pyrolysis and is in heat-transferring operative connection with the fuel, the effect is achieved that the necessary heat input into the fuel can take place and the execution of the pyrolysis and the ignition of the fuel, in particular in the form of dust, can be implemented by means of the electrically operated heating and/or ignition device and are ensured. A further aspect of the invention is therefore also that the amount of thermal energy required within the burner for the origination and execution of the initial pyrolysis and ignition is input into the fuel at a surface in the burner interior, in particular of the burner, that is in contact or in operative connection with the flowing fuel with a dwell time sufficient for the execution of the initial pyrolysis and ignition.

A further aspect of the invention is expedient here, that the amount of thermal energy required within the burner for the origination and execution of the initial pyrolysis and ignition is input into the fuel at a contact surface of the heating and/or ignition device in the burner interior that is in contact or in operative connection with the fuel in the burner interior with a dwell time sufficient for the input of the required amount of thermal energy into the fuel to produce the initial pyrolysis and ignition. This achieves the effect that a sufficiently great contact surface for heat input into the fuel transported past is ensured.

It is therefore provided according to the invention that the thermal energy is generated by means of an electrical heating and/or ignition device formed as a constituent part of the fuel nozzle and at least partially as a stabilizing ring with a toothed rim and arranged in the mouth region of the fuel nozzle. Therefore, the burner nozzle or fuel nozzle that is usually present in the case of burners, and in particular the stabilizing ring with a toothed rim that is possibly provided and arranged there, is formed here as the heating and/or ignition device that electrically generates thermal energy and delivers it to or into the burner and/or to the fuel. The burner according to the invention is therefore characterized in that a stabilizing ring with a toothed rim is a constituent part of the electrical heating and/or ignition device arranged in the mouth region of the fuel nozzle. The method according to the invention provides that the required amount of thermal energy is input into the burner and/or into the transported fuel by means of a heating and/or ignition device which is arranged in the mouth region of the fuel nozzle and a constituent part of which is a stabilizing ring with a toothed rim.

According to a refinement of the invention, it is of advantage here that the toothed stabilizing ring is arranged at a distance in front of the mouth opening of the pipe arranged concentrically within the fuel pipe and at the center of the burner.

It is also of advantage in this case for ensuring the execution of the necessary pyrolysis that the fuel nozzle is formed in such a way that the toothed stabilizing ring is formed in a radially inwardly directed manner and takes up, delays and diverts a stream of fuel or stream of fuel dust transported in a fuel transport cross section, which the invention provides in a development.

It is then particularly expedient here if the fuel nozzle and/or the stabilizing ring with a toothed rim has/have at least one heating wire through which electric current can flow and/or at least one inductively heated region, which respectively generate(s) and provide(s) the amount of thermal energy required within the burner for the origination and execution of the initial pyrolysis and ignition. This is also provided by the invention in a refinement.

The burner, in particular coal dust burner, is distinguished by the fact that the electrical heating and/or ignition device generates and/or provides the amount of thermal energy required, in particular when starting up the burner, in particular coal dust burner, within the burner for the origination and execution of the initial pyrolysis and ignition in the region of the fuel ignition site forming without the use of a further additional liquid, gaseous or solid fuel apart from the fuel initially to be pyrolyzed and ignited.

It is therefore also expedient here that the burner has a surface in the burner interior and/or the electrical heating and/or ignition device has a contact surface, or said burner and/or device is/are in heat-conducting and/or heat-transferring operative connection with such a surface, which during the starting-up operation of the burner is/are in contact or in operative connection with the fuel transported in the fuel pipe with a dwell time sufficient for the execution of the initial pyrolysis and ignition, which the invention likewise provides.

It is then also of advantage here in a refinement according to the invention of the invention that an inner surface region of the fuel pipe at the burner mouth that is in heat-conducting and/or heat-transferring operative connection with the fuel nozzle having the stabilizing ring with a toothed rim forms the surface in the burner interior and/or the contact surface.

It is then also expedient in this case that the surface in the burner interior is entirely or partially a constituent part of the contact surface of the heating and/or ignition device, which the invention likewise provides.

A particularly advantageous refinement of the heating and/or ignition device is also that the fuel nozzle has in the mouth region a number of windings formed by a heating wire or resistance wire, which form the heating and/or ignition device, which the invention likewise provides.

The windings of the heating wire may extend here through the stabilizing ring and its toothed rim, which the invention also provides in a refinement.

In order also to be able to heat adjacent surface regions in the burner interior and form them as a heat source, the invention is also distinguished by the fact that the windings of the heating wire extend through surface regions in the burner interior of the fuel nozzle and the fuel pipe that are adjacent the stabilizing ring with a toothed rim.

However, it is not only possible that the electrical heating and/or ignition device is a constituent part of the fuel nozzle having a stabilizing ring with a toothed rim, it is also possible that the fuel nozzle and/or the stabilizing ring with a toothed rim form the electrical heating and/or ignition device, which the invention likewise provides.

In order to ensure the ignition of the pyrolysis products produced during the pyrolysis, the invention is distinguished by the fact that the fuel nozzle and/or the stabilizing ring with a toothed rim and/or the surface regions in the burner interior is/are formed as heatable to a temperature of at least 200° C., in particular of 450° C., preferably of between 600° C. and 700° C.

However, in addition to the heating and/or ignition device formed in the stabilizing ring with a toothed rim or formed as a stabilizing ring with a toothed rim, further electrical ignition and/or heat sources may also be provided in the burner. Therefore, in a development, the invention is also characterized by ignition and/or heat sources which form a combination of the heating and/or ignition device converting electric current into thermal energy with a further heating and/or ignition device producing an arc or producing hot air.

In particular, it is provided here in a development of the invention that the further electrical heating and/or ignition device comprises or forms a plasma burner, which is directed in particular at the surface in the burner interior and/or the contact surface and/or the stabilizing ring with a toothed rim and transfers thermal energy to this surface and/or the transported fuel.

It may, however, also be possible to use a hot-air feed pipe as an electrical heating and/or ignition device, so that the invention also provides that the further electrical heating and/or ignition device comprises or forms a hot-air feed pipe which is equipped with an electrical heating device, is directed with its mouth region in the burner interior onto the surface in the burner interior and/or the contact surface and/or the stabilizing ring with a toothed rim and transfers thermal energy to this surface and/or the transported fuel.

Consequently, a number of heating and/or ignition devices, in particular of various types, may be realized and arranged on a burner. A combination of two heating and/or ignition devices, in particular the combination of a heating and/or ignition device converting electric current into thermal energy and a heating and/or ignition device producing an arc or producing hot air, is possible. The combination may therefore consist in that there are formed and arranged in the burner interior within a burner a number of ignition and/or heat sources or heating and/or ignition devices, which respectively either input/introduce thermal energy into components or structural elements or burner devices, or transfer the energy to them, or input the thermal energy directly into the transported fuel. It is also possible that one of these two types of ignition and/or heat source or heating and/or ignition device is respectively arranged and formed in the burner interior within the burner.

Finally, in a further refinement according to the invention, the burner is also distinguished by the fact that the electrical heating and/or ignition device and/or the further electrical heating and/or ignition device generate(s) and/or provide(s) the amount of thermal energy required, in particular when starting up the burner, within the burner for the origination and execution of the initial pyrolysis and ignition in the region of the fuel ignition site forming without the use of a further additional liquid, gaseous or solid fuel apart from the fuel initially to be pyrolyzed and ignited.

It is also of advantage if the stabilizing ring with a toothed rim is at least part of an ignition and/or heat source, which the invention finally also provides in a refinement of the burner.

In an advantageous refinement of the method according to the invention, it is provided that the amount of thermal energy required during the starting up of the burner within the burner for the origination and execution of the initial pyrolysis and ignition is generated without the use of a further additional liquid, gaseous or solid fuel apart from the fuel initially to be pyrolyzed and ignited.

It is advantageous here in a further refinement of the invention that the amount of thermal energy required within the burner for the origination and execution of the initial pyrolysis and ignition is input into the fuel at a surface in the burner interior of the burner that is in contact or in operative connection with the flowing fuel with a dwell time sufficient for the execution of the initial pyrolysis and ignition and/or is input into the fuel at a contact surface of the heating and/or ignition device in the burner interior that is in contact or in operative connection with the fuel in the burner interior with a dwell time sufficient for the input of the required amount of thermal energy into the fuel to produce the initial pyrolysis and ignition, wherein the surface and/or the contact surface is/are formed by or comprise(s) the fuel nozzle and/or the stabilizing ring with a toothed rim.

The fuel nozzle and/or the stabilizing ring can in particular be formed in an advantageous way as an electrically operated heating and/or ignition device by the fuel nozzle and/or the stabilizing ring having a heating wire through which electric current can flow or an inductively heated region, by means of which the amount of thermal energy required within the burner for the origination and execution of the initial pyrolysis and ignition is respectively generated and provided, which the invention likewise provides.

However, a plasma burner or a device producing an arc may also be used as the electrically operated heating and/or ignition device, so that it is also possible that the amount of thermal energy required within the burner for the origination and execution of the initial pyrolysis and ignition is generated and provided by means of an electric arc, in particular by means of a plasma burner, which is in particular directed onto the surface in the burner interior and/or the contact surface and transfers the required amount of thermal energy to this surface and/or the transported fuel.

A further possibility for generating the thermal energy necessary for initiating the initial pyrolysis or the initial pyrolysis process is that of bringing hot air into the region of the ignition site or the site of the pyrolysis process, wherein the amount of thermal energy required within the burner for the origination and execution of the initial pyrolysis and ignition is then generated and provided by means of a hot-air feed pipe which is equipped with an electrical heating device, is directed with its mouth region in the burner interior in particular onto the surface in the burner interior and/or the contact surface and transfers the required amount of thermal energy to this surface and/or the transported fuel.

In particular in this case, but also in all other cases, the burner mouth with its burner internals, provided on/in it, is suitable in particular for the energy input necessary for the execution of the pyrolysis process and ignition of the fuel such that the amount of thermal energy required for the origination and execution of the initial pyrolysis and ignition is input into the fuel by way of a surface in the burner interior and/or a contact surface which is formed by or comprises the fuel nozzle and/or the stabilizing ring with a toothed rim.

However, it is also possible that the area to be provided for the heat input into the fuel is not a direct constituent part of the heating and/or ignition device, but is provided by a burner device in heat-conducting or heat-transferring operative connection with it, so that the surface in the burner interior and/or the contact surface is formed by an inner surface region of the fuel pipe at the burner mouth that is in heat-conducting and/or heat-transferring operative connection with the heating and/or ignition device, in particular the fuel nozzle and/or the stabilizing ring with a toothed rim.

In order to ensure the ignition of the fuel and implement the necessary initial pyrolysis, it has proven to be particularly expedient if the thermal energy necessary for these processes is generated in the region of the ignition site of the fuel and then on the one hand input into the fuel by way of an effective surface or contact surface in this region, but on the other hand also conducted into other regions and to other effective surfaces and contact surfaces of the burner, in particular inner surface regions in the burner interior of the fuel pipe, by way of heat conduction and/or heat radiation. It is therefore also advantageous if the amount of thermal energy required, in particular when starting up the burner, within the burner for the origination and execution of the initial pyrolysis and ignition is generated and/or provided by means of the heating and/or ignition device in the region of the ignition site forming.

Depending on the fuel, temperatures sufficiently high for the implementation of the pyrolysis process and the ignition of the fuel lie in the range of 200° C., in particular 450° C., and preferably in the range between 600° C. and 700° C. The invention therefore provides in a further refinement of the method that the surface in the burner interior and/or the contact surface and/or the stabilizing ring with a toothed rim and/or an inner surface region of the fuel pipe at the burner mouth is heated by means of the heating and/or ignition device to a temperature of 200° C., in particular of 450° C., preferably of between 600° C. and 700° C. This allows thermal energy to be transferred to the fuel in a way that is sufficient for the implementation of the pyrolysis and the ignition of the fuel. The ignition temperature of solid fuels increases with an increasing degree of coalification, that is to say with a smaller fraction of volatile constituents.

The fuel in the form of particles, in particular in the form of dust, may be transported in the burner, in particular in the fuel pipe or fuel feed pipe, with a concentration of between 0.1 and 10 kg (fuel)/(carrier gas) and/or a transporting speed of between 5 and 30 m/s in the burner. The invention therefore also finally provides in a refinement of the method according to the invention that the fuel in the form of particles, in particular in the form of dust, is carried along in the burner on the surface in the burner interior and/or the contact surface and/or the stabilizing ring with a toothed rim and/or the inner surface region of the fuel pipe at the burner mouth with a concentration of between 0.1 and 10 kg (fuel)/kg (carrier gas) and/or a transporting speed of between 5 and 30 m/s.

The burner, in particular coal dust burner, is preferably formed as a component that is suitable for an indirect firing system, wherein the gas transporting the fuel has a higher dust loading of 0.4 kg (fuel)/kg (gas).

The overall aim of the invention is therefore to implement the ignition of solid fuels in the form of particles, in particular in the form of dust, on the basis of lignite, hard coal, biomass or other substances in burner devices suitable for this, i.e. in particular burners or coal dust burners, without the use of an additional gaseous or liquid fuel. As a result, there is no need for any of the infrastructure that is otherwise required for the firing of gaseous or liquid fuels or auxiliary fuels. In particular, the invention is suitable for use for indirect firing systems. Existing power plants can also be retrofitted with it.

The invention therefore relates to a burner device or a burner, in particular coal dust burner, and to a method for solid fuel in the form of particles, in particular in the form of dust, with which coal dust or biomass or mixtures thereof can be ignited without the aid of further gaseous or liquid fuels, exclusively by supplying electrical energy. For this purpose, the burner device or the burner or coal dust burner has in particular the special features or combinations presented below, which are explained below on the basis of the drawing representing an exemplary embodiment.

The invention is explained more specifically below by way of example on the basis of a drawing.

The drawing, comprising a single FIGURE, shows in a schematic sectional representation a cross section of a coal dust burner 12 installed in the masonry lining or a bend in the pipe wall of a steam generator of a large-scale thermal power plant. This coal dust burner 12 comprises a fuel pipe 1, which allows the transportation and concentration of a carbon-containing fuel in the form of dust transported therein into the mouth region 13 of the coal dust burner 12, where there is formed a fuel nozzle 2, which on account of its geometrical design completely takes up, delays and diverts the stream of fuel or stream of fuel dust transported in the fuel transport cross section 8 by means of a customary toothed stabilizing ring 9. As a result, a sufficient dwell time of the fuel in a sufficient concentration in the mouth region 13 of the coal dust burner 12 is achieved, providing the time for the execution of the required pyrolysis process in the transported stream of fuel and its ignition. In the mouth region 13, the fuel nozzle 2 has a number of windings, which are formed by a heating wire 20 or resistance wire and form a (first) heating and/or ignition device 14'. The windings of the heating wire 20 extend through the stabilizing ring 9 and its toothed rim 15 and also surface regions 16, 17, 18 and 19 adjacent thereto of the fuel nozzle 2 and the fuel pipe 1 that are in the burner interior. By means of the heating wire 20, and consequently by means of the (first) heating and/or ignition device 14', which forms a (first) ignition and/or heat source 3', a heat transfer and heat input sufficient for the initiation of the initial pyrolysis process and the ignition of the transported fuel is introduced and input initially into these components and structural elements of the burner 12, which then for their part in turn input the heat transfer and heat input necessary for the initiation of the initial pyrolysis process and the ignition of the fuel into the stream of fuel transported past them. Similarly, a further heating and/or ignition device 14, which is formed here as an ignition lance, forms a further ignition and/or heat source 3 and allows a heat transfer and heat input into the transported stream of fuel that is sufficiently high for the initiation of the initial pyrolysis process, is arranged with its tip in the region of the ignition site of the transported fuel that is forming. The oxygen necessary for the ignition and combustion or oxidation of the fuel is fed in particular through the central pipe 10 or core-air pipe 7 in the region of the ignition site. Additionally and alternatively, the oxygen necessary for the combustion may be fed to the region of the ignition site by the carrier gas transporting the fuel in the fuel pipe 1, for example an oxygen-containing gas (generally atmospheric air) or $CO_2$-containing recirculation gas. The region of the ignition site is located in the region of the toothed rim 15 of the stabilizing ring 9. The oxygen necessary for the ignition or for the immediate oxidation of the pyrolysis products released from the dust particles of the fuel is made available to this region of the ignition site by way of the carrier gas or the oxygen-containing gas or the recirculation gas. The amount of heat generated here in the region of the ignition site by means of the (first) heating and/or ignition devices is input directly or at least partially by means of heat conduction and/or heat transfer, for example by way of radiant heat, into the fuel nozzle 2 and the stabilizing ring 9 with the toothed rim 15 and is conducted by the latter by way of heat conduction into adjacent inner surface regions 16, 17, 18, 19 of the fuel transporting pipe 1 and/or the fuel nozzle 2, so that the heat input in the fuel required for the origination and execution of the initial pyrolysis and ignition in the region of the ignition site is made available over a corresponding path, along which the fuel partially comes into contact with the inner surface regions 16, 17, 18 19 and flows to the burner mouth 3. Furthermore, it is possible that the heat input necessary for the ignition of the fuel and initial pyrolysis is made available exclusively by means of the first heating and/or ignition device 14'. However, it is also possible that thermal energy is also at the same time input into the fuel by means of the further heating and/or ignition device 14.

The first ignition and/or heat sources 3' and the further ignition and/or heat source 3—at least altogether, but possibly also individually—provide the thermal and ignition energy necessary for the pyrolysis, i.e. the initial pyrolysis process that is being executed, and ignition of the fuel in the form of particles, in particular in the form of dust, exclusively by the use of electrical energy as an electrically heated ignition and/or heat source 3, 3' or heating and/or ignition device 14, 14' without the use of further additional liquid or gaseous fuels.

After ignition for the first time of the fuel in the form of dust and the formation of a stable flame, the initial pyrolysis process, i.e. the origination and implementation of the initial pyrolysis, and the initial ignition are completed and the electrically operated heating and/or ignition device(s) 14, 14' is/are switched off. The further combustion of the transported fuel comprising continuous execution and continuous formation of the pyrolysis process, with final ignition of the pyrolysis products, then takes place in the usual way by the input of thermal energy generated by the burner flame into the fuel transported in the coal dust burner.

The thermal energy required for the origination and execution of the initial pyrolysis and ignition is input in the region of the fuel nozzle 2 and/or the stabilizing ring 9, and also the inner surface region 16 of the fuel pipe 1 at the burner mouth, into the fuel flowing along said region with a sufficient dwell time. These stated areas or area regions form the surface 16, 17, 18, 19 in the burner interior along which the amount of thermal energy required in the coal dust burner 12 for the origination and execution of the initial pyrolysis and ignition is input into the fuel at a surface 16, 17, 18, 19 in the burner interior that is in contact or in operative connection with the flowing fuel with a dwell time sufficient for the execution of the initial pyrolysis and ignition.

This surface 16, 17, 18, 19 in the burner interior is entirely or partially a constituent part of a contact surface of the (first) heating and/or ignition device 14', since the fuel nozzle 2 with the stabilizing ring 9 arranged on it with the toothed rim 15 and/or the surface 16, 17, 18, 19 in the burner interior is/are formed with the aid of the electrical heating wire 20 or by means of an inductive heating as the (first) heating and/or ignition device 14' and form the first heated electrical ignition and/or heat source 3'.

However, it is also possible to form the heating and/or further ignition device 14 that is represented in the FIGURE as a device producing an electric arc, in particular a plasma burner, which is directed onto the surface in the burner interior and/or the contact surface and/or the fuel flowing past and transfers the required amount of thermal energy to this surface or fuel. In a way that is not represented, the further heating and/or ignition device 14 may also be formed by a hot-air feed pipe, which is equipped with an electrical heating device for generating the required amount of thermal energy, is directed with its mouth region in the burner interior onto the surface in the burner interior and/or the contact surface and/or the fuel flowing past and transfers the required amount of thermal energy to this surface or fuel.

The fuel nozzle 2 comprises a toothed stabilizing ring 9, which is formed and arranged at the end of the fuel pipe 1 at the mouth and forms the mouth end 13 thereof. In this case, the fuel nozzle 2, and in particular the toothed stabilizing ring 9, is also arranged and formed with or at a—desired, determined and possibly determinable—distance in front of the mouth opening of the concentric fuel pipe 1 within the same and at the center of the burner arranged core-air pipe 7.

The fuel nozzle 2 and/or the surface regions 16, 17, 18, 19 in the burner interior are entirely or partially heated at least substantially electrically, preferably exclusively electrically, to a temperature of at least 200° C., depending on the nature of the fuel to a temperature of preferably >400° C. On account of the fact that the stream of fuel dust is taken up, delayed and diverted, preferably completely, in the axial and radial directions of flow a dwell time sufficient for the pyrolysis of the dust particles of the stream of fuel is produced at the fuel nozzle 2, and the preferably completely taken-up and delayed dust particles are heated in such a way that they degas and release ignitable pyrolysis products, wherein this pyrolysis process is started and maintained before the ignition for the first time of the fuel, consequently of the burner 12, exclusively by means of the thermal energy that is provided by the electrically heated fuel nozzle 2 and/or the electrically heated surface 16, 17, 18, 19 in the burner interior and/or the electrically heated ignition and/or heat sources 3, 3', in particular the stabilizing ring 9 with the toothed rim 15.

The further ignition and/or heat source 3 preferably supports the pyrolysis and ignites released pyrolysis products, and possibly does this additionally, if for example the electrically heated surfaces 16, 17, 18, 19 in the burner interior of the fuel nozzle 2 or the stabilizing ring 9 are electrically heated in some other way, for example inductively or by means of a heating wire 20 led into the fuel nozzle 2.

In a refinement of the invention that is not represented any more specifically, it may be provided here that a plasma flame, which may be produced with the aid of electrical energy without an additional fuel, is used as the further heat source 3. The plasma flame is in this case formed with the aid of a suitable lance in the direct vicinity of the fuel nozzle 2 and/or the stabilizing ring 9, whereby the combustible dust/fuel dust is heated up to such an extent that the pyrolysis process takes place without delay and the oxidation can take place promptly. This ignition and/or heat source 3 in the form of a plasma flame may also be additionally provided if the fuel nozzle 2 and/or the surface 16, 17, 18, 19 in the burner interior is entirely or partially electrically heated in some other way, for example inductively or by means of a heating wire 20 let into the fuel nozzle 2 and/or into the surface 16, 17, 18, 19 in the burner interior. Here, the combustible dust/fuel dust is then additionally heated by the formation of the plasma flame with the aid of the suitable lance in the direct vicinity of the fuel nozzle 2 to such an extent that the pyrolysis process is supported and the oxidation of the pyrolysis products released from the fuel dust particles at the electrically heated fuel nozzle 2 or the surface 16, 17, 18, 19 in the burner interior or the ignition and/or heat sources 3, 3' can take place promptly.

Furthermore, the fuel pipe 1 has a device 4, with which a starting dust streamer can be temporarily produced, wherein to increase the release of heat this streamer is directed specifically into the ignition and/or heat sources 3 and/or 3' in order subsequently, once ignition has taken place, to be broken up again, without thereby impairing the ignition conditions specified above. The device 4 may be configured as a rail, which builds up the fuel dust with the aid of a swirler 5 at a specific circumferential position and deflects it in the axial direction.

It is possible in principle that, for the exclusive or additional provision of a sufficient ignition temperature and for ensuring sufficient pyrolysis or for supporting the pyrolysis, an electrically heated heating wire 20 or some other form of electrical heating, for example inductive heating, is integrated as an ignition and/or heat source 3, 3' in the fuel nozzle 2 and/or in the surface 16, 17, 18, 19 in the burner interior. It is exclusive if an ignition and/or heat source 3, 3' is only formed at this point. It is additional if such a heat source or some other heat source 3 is also formed at another point of the burner.

Also arranged in the burner 12 is a fuel lance 6, which introduces part of the fuel/combustible dust/fuel dust specifically into the further ignition and/or heat source 3, which is then preferably formed as a plasma flame, whereby the carbon-containing dust particles are heated up to a very great extent and the release and ignition of pyrolysis products from the fuel leads to the formation of a flame, which in turn, as a result of the release of heat and in particular as a result of the heat radiation of the heated-up fuel particles that is given off continuously over the electromagnetic spectrum, brings about the pyrolysis of the fuel particles in the form of dust taken up and delayed at the fuel nozzle 2. The fuel lance 6 may in this case be formed as an independent component or as an annular cross section surrounding the further ignition and/or heat source 3.

However, it is also possible instead of combustible dust to introduce into the further ignition and/or heat source 3 other media in dust form, even non-combustible media, by means of a suitable lance 6 or an annular cross section surrounding the lance of the further ignition and/or heat source 3, so as to achieve the effect of an emission of heat from these dust particles that is conducive to the pyrolysis of the fuel dust particles taken up and delayed at the fuel nozzle 2.

The fuel nozzle 2 may be insulated on its side facing away from the stream of fuel with the aid of refractory materials, such as for example textiles or dimensionally stable components of ceramic fibers, in order to reduce the heat losses to the enclosing air 11 surrounding the fuel pipe 1 and reduce the electrical energy requirement for the heating.

In particular, the fuel nozzle 2 is heated up, in particular inductively, to a suitable temperature and to the temperature that is respectively intended.

An ignition lance 6 operated with a solid fuel in the form of dust and formed as a heating and/or heat source may also be provided so as to produce a flame in the vicinity of the fuel nozzle 2, which is preferably ignited with the aid of an electrical igniter by adding pure oxygen or a gas mixture with a very high oxygen partial pressure.

Since the formation of a plasma flame as a further ignition and/or heat source 3 may require a relatively high level of technical expenditure in terms of construction and/or apparatus, it may be provided that the ignition is implemented or at least supported by means of sufficiently hot air. This is possible since the ignition of the coal dust ultimately takes place by the pyrolysis of the volatile matter and the subsequent commencement of the reaction of the volatile matter with the oxygen fed in. Decisive for this are the temperature conditions in the region of the mixing zone between this hot air and the fuel and the dwell times. Hot air temperatures of >450° C., for example hot air produced by means of an electrical heating and/or ignition device 14 with a temperature in the range of 650° C., are sufficient to start the pyrolysis and ignition process, for example in the case of dry lignite.

Such a heating and/or ignition device 14 may for example be installed in the burner represented in the FIGURE. The hot air is then introduced in the region of the mouth 13 of the dust nozzle or burner nozzle 2 and mixed there with the fuel, in particular in the form of dust, preferably lignite dust. This ignitable mixture is then located directly in the region of the backflow zone of the burner, so that, given an appropriately high swirl, the flame produced after the ignition of the fuel is distributed over the circumference of the burner and forms a stable flame. In principle, this method may be used in the case of any form of burner in which the mixing zone between fuel and air or combustion oxygen or oxidizing agent is located in the region of a flame holder, here the stabilizing ring 9. The hot air is mixed into the fuel in the starting region in the burner interior of the mixing zone between fuel and air. In this case, the speed of the fuel is so low that good mixing of the hot air with the fuel with a sufficient dwell time is ensured on the path remaining up to the burner mouth.

To produce the high-temperature hot and/or ignition air, a hot-air pipe may be provided as a further ignition and/or heat source 3, through which the ignition air to be heated up is transported and is thereby heated by means of an electrical heating within the hot-air pipe that is provided in or on the hot-air pipe. The outlet of the hot-air pipe is located near the dust nozzle or fuel nozzle 2 within the burner upstream of the stabilizing ring 9 in the direction of flow, so that an immediate mixing of the hot air with the fuel fed through the fuel pipe 1 can take place. In this case, the hot-air pipe may be led through the primary-air pipe, provided at the burner, the core-air pipe 7, through the secondary-air pipe, the enclosing-air pipe, or else be carried to this point from all sides. The electrical device provided for the heating is intended to allow heating up of the air to high temperatures sufficient for the heating up and pyrolysis of the fuel. The positioning of the same within the burner is in this case preferably chosen such that it is possible with low expenditure in terms of construction.

The heated-up ignition air may in this case also be mixed directly with a medium in the form of dust, preferably combustible dust, with the aid of a lance 6 or an annular cross section surrounding the ignition air lance, so that a great heat radiation of the then hot dust particles leads to a heat transfer to the dust particles taken up and delayed at the fuel nozzle, whereby these particles degas and release ignitable pyrolysis products.

The invention allows the conversion of boilers or steam generators to igniting and supporting firing with existing combustion of coal dust, in particular dry lignite dust, and is of advantage in particular in the case of indirect firing and an accompanying dismantling of the supply infrastructure for fuels in the form of oil or gas. Such firing, in particular indirect firing, may also comprise mixtures of the various fuels. A mixture of dry lignite and sawdust or other biomass is expedient.

Igniting and supporting firing on the basis of indirect firing may also be used in steam generators with direct main firing of hard coal or raw lignite and allows here in particular the steam generator to be operated at loads that are as low as desired, with firing that is nevertheless stable. The indirect firing is in this case expediently performed with higher dust loadings of >0.4 kg (combustible dust)/kg (gas).

In the present context and in connection with the invention, direct firing or a direct firing system is understood as meaning that, after its preparation/grinding in a grinding mill, in particular coal mills, fuel is fed directly to the burners in the furnace of the large-scale steam generator. Indirect firing or an indirect firing system is understood as meaning intermediate storage of the fuel after the preparation/grinding in the grinding mill and in one or more storage containers or silos, from which the fuel is then transported to the burners—possibly only later—as and when required and according to requirements.

In principle, the combustion of fuel in the form of dust is used in the steam generators of thermal power plants. For this purpose, the steam generators are equipped with coal dust burners 12. The coal dust burners 12 thereby perform the function of allowing the pyrolysis and combustion process described below.

The combustion of solid fuel in the form of dust, for example coal dust, requires its initial ignition. Combustion means that energy is released by oxidation of the combustible constituents that are present in the fuel. However, quite specific conditions have to be satisfied for the ignition of the fuel. If these conditions are not satisfied, the fuel does not ignite and the energy chemically bound in it is not released.

Since the oxidation of the carbon locked in the fuel requires a great amount of initial thermal energy, in the ignition of the fuel the volatile constituents contained in the fuel are ignited first. In order that they can be ignited, they must emerge from the fuel dust in a gaseous form. Under the influence of heat, the volatile constituents emerge from the fuel dust and thus come into contact with the oxygen necessary for the oxidation. The emergence of the volatile constituents into the gas phase is referred to as pyrolysis.

In a continuously executed combustion process, the heat required for the individual method steps originates from the release of energy of the exothermic combustion reactions. To set up a continuous combustion process, however, first thermal energy must be made available from a source (another source) to instigate the method. For this, it has so far been customary initially to burn a gaseous or liquid fuel. The invention achieves the effect of dispensing with the need for the combustion of gaseous or liquid fuels that are otherwise necessary for the ignition of a solid fuel in the form of dust.

Explained more specifically below as individual method steps of the pyrolysis and combustion process are 1. Feeding in the fuel and the oxygen carrier gas
2. Allowing the dwell time and the heat transfer to the fuel
3. Providing oxygen
4. Setting up the pyrolysis and combustion process
4a. Heating up the fuel nozzle
4b. Use of a plasma burner
4c. Other heat sources
5. Pyrolysis
6. Combustion of the pyrolysis products
7. Combustion of the carbon
8. Formation of a flame 1. Method Step: Feeding in the Fuel and the Oxygen Carrier Gas For this purpose, the fuel prepared in the form of dust is transported to a burner 12 with the aid of a carrier gas in fuel-carrying lines. Also, further lines carry air or some other oxygen carrier gas into the burner 12, in order to provide an amount of oxygen that is required for the combustion of volatile constituents and carbon in the fuel. The carrier gas of the fuel in the fuel-carrying lines may also contain oxygen. The concentration of fuel in the carrier gas may be for example between 0.1 and 10 kg(fuel)/kg(carrier gas). The transporting speed of the fuel may lie in the range between 5 and 30 m/s. The pyrolysis and combustion process takes place at the mouth region 13 of the burner 12, i.e. where the pipes of the burner 12 carrying fuel and oxygen carrier gas open out into the furnace of a steam generator.

2. Method Step: Allowing the Dwell Time and the Heat Transfer to the Fuel

The burner 12 also performs the function of allowing the dwell time necessary for the heat transfer to the fuel and the origination and execution of the pyrolysis. The dwell time is based on the required amount of heat or the temperature of the fuel and the thermal power acting on the fuel by way of a heat transfer. This is realized in the burner 12 by the amount of heat or the temperature corresponding to the requirements of the pyrolysis and the setting up of the oxidation of volatile constituents of the fuel. A high dwell time thereby ensures a sufficient heat transfer. This is enhanced by the structural design of the burner 12, in that the fuel in the form of dust is influenced at a suitable point at the mouth region 13 of the burner 12 or in its vicinity by delay, deceleration, swirling or diversion in its movement in such a way that the thermal power available and acting on the fuel leads to a sufficient transfer of heat to the fuel, required for the initiation of the pyrolysis and the combustion of the pyrolysis products. The component realized for influencing the movement of the fuel in the burner 12 is the fuel nozzle 2 or the flame holder. The necessary amount of heat must be made available at the aforementioned suitable point. At the same time, the dwell time is chosen such that an ignitable mixture of gaseous pyrolysis products and the oxygen carrier gas is produced by the pyrolysis.

3. Method Step: Providing Oxygen

The carrier gas, which transports the fuel dust, may already contain an amount of oxygen sufficient for the oxidation of the pyrolysis products. Should it be advantageous or necessary from a process engineering viewpoint to set a low oxygen concentration in the carrier gas or to use an inert gas as the carrier gas, the burner 12 may alternatively have lines for providing air or other oxygen carrier gases, which provide at their mouth the required oxygen for the combustion of the gaseous pyrolysis products or for the subsequent combustion of the carbon contained in the fuel.

4. Method Step: Setting Up the Pyrolysis and Combustion Process

To set up the entire pyrolysis and combustion process, heat must be transferred to the fuel at the beginning of the continuous feeding of fuel in the form of dust. In the prior art, usually a gaseous or liquid auxiliary fuel is first electrically ignited, i.e. a spark or arc is used to feed thermal energy that is sufficient to achieve an oxidation of the auxiliary fuel for a short time to an ignitable mixture of oxygen carrier gas and gaseous or liquid fuel. The oxidation or combustion of the auxiliary fuel has the effect of releasing thermal energy, which leads to a continuous combustion of the fed-in liquid or gaseous fuel. The thermal energy released from this combustion is used to ignite a fuel in the form of dust, i.e. to bring about the initial pyrolysis and ignition of the fuel in the form of dust. As soon as the fuel in the form of dust has been ignited and burned, the combustion of the liquid or gaseous auxiliary fuel can be ended, since the combustion of the fuel in the form of dust continues independently as a result of the heat released during the combustion. For the igniting of fuel in the form of dust, a brief spark or arc is not sufficient to bring about the pyrolysis, i.e. the emergence of volatile constituents from the fuel with the aim of producing a combustible mixture with an oxygen carrier.

The invention thus provides a method and a coal dust burner 12 that generate and provide the amount of heat required for the pyrolysis and the combustion of the volatile constituents of the fuel in the form of dust exclusively electrically, without combustion of an additional liquid or gaseous auxiliary fuel.

5. Method Step: Pyrolysis

The pyrolysis, i.e. the emergence of volatile constituents from the solid fuel in the form of dust, already begins at temperatures that are lower than those required for the oxidation of the carbon locked in the fuel. The so-called pyrolysis temperature is in this case dependent on the properties of the fuel in the form of dust and can be determined experimentally. It is required for the pyrolysis of the volatile constituents of the fuel that there is a sufficient dwell time, during which a sufficient amount of heat can be input into the fuel, allowing the fuel to be heated up in such a way that the temperature required for the origination and implementation of the initial pyrolysis is achieved. Provided for this is at least the first heat source 3', which is adapted to the available dwell time and is possibly supported by the further heat source 3. If there is an insufficient dwell time or amount of heat, so that the initial pyrolysis cannot be brought about, the combustion of the solid fuel will not take place.

6. Method Step: Combustion of the Pyrolysis Products

The gaseous volatile constituents originating from the fuel ignite under specific conditions. Firstly, sufficient oxygen for the combustion must be available. Furthermore, a ratio of oxygen and combustible substances that is suitable for the combustion, i.e. an ignitable mixture of the oxygen carrier gas and the volatile constituents emerging from the fuel, must be produced. The capability of the mixture to ignite is described by means of the lower and upper ignition limits. The ignition limits are those mixing ratios of oxygen and combustible substances within which such a mixture is ignitable. Therefore, a sufficient amount of volatile constituents must first emerge from the fuel in order for ignitable mixtures to be produced. The already previously mentioned dwell time is therefore set such that a sufficient amount of volatile constituents emerges from the fuel. Also, sufficient fuel is provided in order for an ignitable mixture to be produced. This means that the feeding in of air or some other oxygen carrier is arranged such that the volatile constituents emerging and the oxygen carrier gas form an ignitable mixture. Furthermore, for the mixture to ignite, a sufficient temperature must prevail and a sufficient dwell time for heating up to this temperature must be allowed, or to put it another way a sufficient dwell time for the required transfer of heat must be allowed. If this is the case, thermal energy from the exothermic oxidation reactions is released after successful ignition of the mixture.

7. Method Step: Combustion of the Carbon

The thermal energy released from the combustion of the reactant mixture comprising oxygen carrier gas, for example air, and the volatile constituents released from the fuel leads to an increase in the temperature of the products resulting from the combustion and to a further heat transfer to the degassed fuel. The combustion of volatile constituents and of the degassed fuel (residual coke) leads in turn to a release of thermal energy, which allows a stable, continuous combustion process to be produced. The combustion of the degassed fuel is decisively determined by chemical and diffusion processes.

8. Method Step: Formation of a Flame

The released thermal energy from the combustion of the volatile constituents and the residual coke has the effect of bringing about a temperature increase of the gaseous and solid constituents of the flue gas mixture, i.e. the combustion products. As a result of fuel, dust and soot particles at a high temperature, radiation energy is given off to the surroundings by electromagnetic radiation in the range of thermal radiation and also in the range of visible light. In this way, finally a visible flame is produced. Gaseous products of the combustion reactions of a heteroatomic structure also give off thermal radiation in certain wavelength ranges and thus lead to a heat transfer by radiation. In addition, a recirculation of hot flue gas within the visible flame can be achieved by clever guidance of the flow of the combustion air or other oxygen carriers. As a result, a convective heat transfer to the reactants of the combustion is brought about. Together with the previously described radiant heat transfer, the reactants that are continuously fed to the combustion, i.e. the fuel in the form of dust and the volatile constituents emerging from it, are heated up. In this way, a continuously executed combustion is produced, the fuel that is fed in degassing, igniting and burning as a result of taking up heat.

To set up the pyrolysis and combustion process, the heat necessary for setting up the individual process steps must first be provided by a source other than that of the exothermic combustion reactions.

Therefore, method steps that are within the scope of the invention for setting up the pyrolysis and combustion process are described below.

Method Step 4a: Ignition on Hot Surfaces

The amount of heat that is necessary for setting up the method steps of the pyrolysis and ignition of the fuel, i.e. for providing the activation energy of the exothermic reactions of the oxidation of volatile constituents, is provided at a suitable surface, at which the dwell time for the heat transfer is sufficient, in the burner interior within the burner 12. The dwell time for heating up that is necessary for the origination and execution of an initial pyrolysis and ignition of the fuel in the form of dust can in this case be achieved structurally by internals that delay, decelerate, divert or swirl the fuel. These internals or surfaces may be the fuel nozzle 2 with the toothed stabilizing ring 9 or a flame holder.

Since the fuel is influenced in its movement by the fuel nozzle 2 and/or the toothed stabilizing ring 9 (also referred to as the flame holder), the dwell time necessary for the individual method steps is realized on this component. It is therefore expedient also to transfer the amount of heat required for the aforementioned method steps to the fuel at this suitable surface. This may take place by the fuel nozzle 2 and/or the stabilizing ring 9 being heated up electrically to a temperature above 200° C. The temperature of the fuel nozzle 2 or the stabilizing ring is in this case based on the specific requirements of the fuel to be pyrolyzed and ignited. By convective heat transfer, heat conduction and heat radiation, an amount of heat that is sufficient to allow the necessary method steps described above is transferred from the hot surface to the fuel. After successful ignition of the fuel, i.e. when there is continuous combustion of the fuel fed in, the heating of the fuel nozzle 2 and/or the stabilizing ring 9 and/or the heat-transferring surfaces of the burner 12 is ended, since from then on the amount of heat required for the individual method steps is made available by the combustion process itself. This means that the first heating and/or ignition device 14' and the further heating and/or ignition device 14, forming the first ignition and/or heat source 3' and the further ignition and/or heat sources 3 and/or in heat-conducting operative connection with them, are switched off.

Method Step 4b: Use of a Plasma Burner

The amount of heat that is necessary to achieve the pyrolysis of the fuel and to activate the oxidation of the pyrolysis products may also be provided by means of a plasma burner. This takes place at a point at which the fuel has a sufficient dwell time, so that sufficient heat can be transferred to the fuel. The use of a plasma flame with the aim of avoiding the combustion of gaseous or liquid fuel for the ignition of solid fuel in the form of dust may go further than merely making heat available, since a plasma has particular chemical-physical properties. The formation of a plasma is particularly suitable for setting up the ignition of solid fuels in the form of dust, because the charge carriers that are present in the plasma, to be specific radicals, ions and electrons, can initiate the chemical reactions that are generally referred to as combustion. The plasma flame is aligned by means of a lance at a suitable point in the vicinity of the burner mouth such that a sufficient transfer of heat to the fuel is achieved for the aforementioned method steps that require the feeding in of an amount of heat, or the fuel in the form of dust comes directly into contact with the free charge carriers that are present in the plasma, so that the combustion can take place. Very high temperatures prevail in a plasma flame, i.e. the charge carriers that are present in the plasma have very high kinetic energy, so that a suitable heat transfer to the fuel takes place to bring about the pyrolysis and the combustion of pyrolysis products. Charge carriers for combustion reactions with the constituents of the fuel in the form of dust are, as it were, available in the plasma. If the other conditions described above for the individual method steps are likewise satisfied, the fuel can in this way be ignited and burned. As soon as the ignition of the fuel has been realized in this way, the ignition of the fuel is maintained with the heat available from the combustion, so that the production of the plasma can be switched off again.

In order to ensure a suitable heat transfer to the fuel or to bring the fuel directly into contact with the charge carriers that are present in the plasma, it is possible to introduce a partial stream from the main stream of the fuel in a separate fuel-carrying lance directly into the plasma flame that is formed, so that a combustion of the fuel in the form of dust, that is to say volatile constituents and fixed carbon, immediately takes place as a result of the high temperatures or the charge carriers that are present in the plasma, while oxygen is provided, for example in the fuel carrier gas in the flame. This plasma-supported coal dust flame leads to a combustion of the coal dust in which heat radiation is given off to the surroundings in a way corresponding to the energy released from the plasma flame and the combustion and the resultant temperatures of the combustion reactants and products. The heat transfer by radiation from this flame then allows the main stream of the fuel to be ignited at the burner in a way corresponding to the previously mentioned method steps.

It is also possible to introduce some other solid, non-combustible, material in the form of dust into the plasma flame, whereby this material undergoes a strong increase in temperature and then gives off heat radiation in a way corresponding to its temperature. Such a particle flame of a non-combustible material is suitable for transferring heat to the stream of fuel, so that the individual method steps of the ignition are made possible.

The instigation of the method steps of pyrolysis and combustion of the pyrolysis products by making a sufficient amount of thermal energy available may in the case of the plasma flame and in the case of the plasma-supported coal dust flame from a partial stream of the fuel and also the particle flame with non-combustible material also be combined here with other heat sources, for example a heated fuel nozzle or a heated flame holder.

Method Step 4c: Other Heat Sources

Apart from a heated surface and the formation of a plasma, it is also possible to use some other heat source. For example, a hot gas, for example air, at a temperature of at least 200° C. may be introduced at a suitable point by means of a suitable lance, so that a sufficient heat transfer to the fuel occurs by conduction, radiation and convection in order to initiate the pyrolysis of gaseous constituents. The hot gas may be heated up for example by means of an electrical heating device.

To support the heat transfer to the fuel by radiation, it is conceivable to introduce combustible dust or non-combustible dust directly into the hot gas.

The invention claimed is:

1. A coal dust burner, comprising a fuel pipe, a fuel nozzle, at least one ignition or heat source and an additional pipe carrying an oxygen-containing gas, wherein the additional pipe is arranged concentrically and fully within the fuel pipe, wherein the at least one ignition or heat source is arranged in the coal dust burner interior and is formed as or comprises an electrical heating or ignition device, which generates or provides the amount of thermal energy required within the coal dust burner for the origination and execution of the initial pyrolysis and ignition in the coal dust burner interior exclusively by conversion of electric current into thermal energy, wherein a stabilizing ring with a toothed rim is a constituent part of the electrical heating or ignition device arranged in the mouth region of the fuel nozzle, and wherein the toothed stabilizing ring is arranged at a distance in front of a mouth opening of the additional pipe and arranged concentrically within the fuel pipe and at the center of the coal dust burner and has at least one heating wire through which electric current can flow.

2. The coal dust burner as claimed in claim 1 wherein the fuel nozzle is formed in such a way that the toothed stabilizing ring is formed in a radially inwardly directed manner and takes up, delays and diverts a stream of fuel or stream of fuel dust transported in a fuel transport cross section.

3. The coal dust burner as claimed in claim 1 wherein the coal dust burner has a surface in the coal dust burner interior, or the electrical heating or ignition device has a surface, or said coal dust burner burner or device is in heat-conducting or heat-transferring operative connection with a surface, which during the starting-up operation of the coal dust burner is in contact or in operative connection with fuel transported in the fuel pipe with a dwell time sufficient for the execution of the initial pyrolysis and ignition.

4. The coal dust burner as claimed in claim 3, wherein an inner surface region of the fuel pipe at the coal dust burner mouth that is in heat-conducting or heat-transferring operative connection with the fuel nozzle having the stabilizing ring with a toothed rim forms the surface.

5. The coal dust burner as claimed in claim 3 wherein the surface is entirely or partially a constituent part of the heating or ignition device.

6. The coal dust burner as claimed in claim 1 wherein the fuel nozzle has, in the mouth region, a number of windings formed by a heating wire or resistance wire, which form the heating or ignition device.

7. The coal dust burner as claimed in claim 6, wherein the windings of the heating wire extend through the stabilizing ring and its toothed rim.

8. The coal dust burner as claimed in claim 6 wherein the windings of the heating wire extend through surface regions in the coal dust burner interior of the fuel nozzle and the fuel pipe that are adjacent the stabilizing ring with a toothed rim.

9. The coal dust burner as claimed in claim 1 wherein the fuel nozzle or the stabilizing ring with a toothed rim form the electrical heating or ignition device.

10. The coal dust burner as claimed in claim 1 wherein the fuel nozzle or the stabilizing ring with a toothed rim or the surface regions in the coal dust burner interior is formed as heatable to a temperature of at least 200° C.

11. The coal dust burner as claimed in claim 1 wherein the electrical heating or ignition device or a further electrical heating or ignition device generates or provides the amount of thermal energy required within the coal dust burner for the origination and execution of the initial pyrolysis and ignition in the region of the fuel ignition site forming without the use of a further additional liquid, gaseous or solid fuel apart from the fuel initially to be pyrolyzed and ignited.

12. The coal dust burner as claimed in claim 11, wherein the electrical heating or ignition device, or the further electrical heating or ignition device generates or provides the amount of thermal energy required when starting up the coal dust burner.

13. The coal dust burner as claimed in claim 1 wherein the stabilizing ring with a toothed rim is at least part of an ignition or heat source.

14. The coal dust burner as claimed in claim 1 wherein the fuel nozzle or the stabilizing ring with a toothed rim or the surface regions in the coal dust burner interior is formed as heatable to a temperature of ≥450° C.

15. The coal dust burner as claimed in claim 1 wherein the fuel nozzle or the stabilizing ring with a toothed rim or the surface regions in the coal dust burner interior is formed as heatable to a temperature of between 600° C. and 700° C.

16. The coal dust burner as claimed in claim 1, wherein the the additional pipe also carries a recirculated flue gas.

17. A method for igniting a fuel in the form of particles in the form of dust, via the coal dust burner as claimed in claim 1, wherein the fuel is transported in the coal dust burner to an ignition site formed within the coal dust burner in the region of the fuel nozzle, and the amount of thermal energy required for the origination and execution of an initial pyrolysis and ignition of the fuel transported to the coal dust burner during the starting up of the coal dust burner is input into the coal dust burner, or the fuel transported therein, exclusively via at least one ignition or heat source arranged in the coal dust burner, which heat source takes the form of a heating or ignition device in the coal dust burner or is in heat-conducting or heat-transferring operative connection with such a heating or ignition device arranged in the coal dust burner, wherein the required amount of thermal energy is generated or provided in the coal dust burner interior exclusively by conversion of electric current into thermal energy, wherein the required amount of thermal energy is input into the coal dust burner or into the transported fuel via a heating or ignition device which is arranged in the mouth region of the fuel nozzle and a constituent part of which is a stabilizing ring with a toothed rim, wherein the toothed stabilizing ring is arranged at a distance in front of a mouth opening of an additional pipe and has at least one heating wire through which electric current can flow, wherein the additional pipe and the toothed stabilizing ring are arranged concentrically within the fuel pipe and at the center of the coal dust burner, and wherein the additional pipe is arranged concentrically and fully within the fuel pipe.

18. The method as claimed in claim 17, wherein the amount of thermal energy required when starting up the coal dust burner within the coal dust burner for the origination and execution of the initial pyrolysis and ignition is generated without the use of a further additional liquid, gaseous or solid fuel apart from the fuel initially to be pyrolyzed and ignited.

19. The method as claimed in claim 17 wherein the amount of thermal energy required within the coal dust burner for the origination and execution of the initial pyrolysis and ignition is input into the fuel at a surface in the coal dust burner interior of the coal dust burner that is in contact or in operative connection with the fuel with a dwell time sufficient for the execution of the initial pyrolysis and ignition or is input into the fuel at a contact surface of the heating or ignition device in the coal dust burner interior that is in contact or in operative connection with the fuel in the coal dust burner interior with a dwell time sufficient for the input of the required amount of thermal energy into the fuel to produce the initial pyrolysis and ignition, wherein the surface or the contact surface is formed by or comprises the fuel nozzle or the stabilizing ring with a toothed rim.

20. The method as claimed in claim 17 wherein a surface in the coal dust burner interior or a contact surface or the stabilizing ring with a toothed rim or an inner surface region of the fuel pipe at the coal dust burner mouth is heated via the heating or ignition device to a temperature of ≥200° C.

21. The method as claimed claim 17 wherein the fuel in the form of particles in the form of dust is carried along in the coal dust burner on a surface in the coal dust burner interior or a contact surface or the stabilizing ring with a toothed rim or an inner surface region of the fuel pipe at the coal dust burner mouth with a concentration of between 0.1 and 10 kg (fuel)/kg (carrier gas) or a transporting speed of between 5 and 30 m/s.

22. The method as claimed in claim 17 wherein the surface in the coal dust burner interior or the contact surface or the stabilizing ring with a toothed rim or an inner surface region of the fuel pipe at the coal dust burner mouth is heated via the heating or ignition device to a temperature of ≥450° C.

23. The method as claimed in claim 17 wherein the surface in the coal dust burner interior or the contact surface or the stabilizing ring with a toothed rim or an inner surface region of the fuel pipe at the coal dust burner mouth is heated via the heating or ignition device to a temperature of between 600° C. and 700° C.

24. A coal dust burner, comprising a fuel pipe, a fuel nozzle, at least one ignition or heat source and an additional pipe carrying a recirculated flue gas, wherein the additional pipe is arranged concentrically and fully within the fuel pipe, wherein the at least one ignition or heat source is arranged in the coal dust burner interior and is formed as or comprises an electrical heating or ignition device, which generates or provides the amount of thermal energy required within the coal dust burner for the origination and execution of the initial pyrolysis and ignition in the coal dust burner interior exclusively by conversion of electric current into thermal energy, wherein a stabilizing ring with a toothed rim is a constituent part of the electrical heating or ignition device arranged in the mouth region of the fuel nozzle, and wherein the toothed stabilizing ring is arranged at a distance in front of a mouth opening of the additional pipe and arranged concentrically within the fuel pipe and at the center of the coal dust burner and has at least one heating wire through which electric current can flow.

* * * * *